US006964184B1

(12) United States Patent
Gregory

(10) Patent No.: US 6,964,184 B1
(45) Date of Patent: Nov. 15, 2005

(54) SHIELDED PUSHBUTTON LOCK

(75) Inventor: Shawn Gregory, Dolores, CO (US)

(73) Assignee: Tuffy Security Products, Inc., Cortez, CO (US)

( * ) Notice: Subject to any disclaimer, the term of this patent is extended or adjusted under 35 U.S.C. 154(b) by 0 days.

(21) Appl. No.: 10/441,969

(22) Filed: May 19, 2003

Related U.S. Application Data

(63) Continuation of application No. 09/838,630, filed on Apr. 19, 2001, now Pat. No. 6,564,602.

(51) Int. Cl.[7] ..... E05B 27/00; E05B 29/00; E05B 33/00

(52) U.S. Cl. ..... 70/360; 70/417; 70/DIG. 56; 292/DIG. 37

(58) Field of Search ..... 70/360, DIG. 56, 70/417, 361, 372, 371, 381, DIG. 20; 292/DIG. 37

(56) References Cited

U.S. PATENT DOCUMENTS 1,342,728 A * 6/1920 Welch ..... 70/252
3,751,953 A * 8/1973 Newman ..... 70/381
3,910,082 A * 10/1975 Patriquin ..... 70/360
4,074,552 A * 2/1978 Smith ..... 70/417
4,122,695 A * 10/1978 Hall ..... 70/417
4,338,804 A * 7/1982 Solovieff ..... 70/134
4,338,806 A * 7/1982 Cox ..... 70/417
4,424,694 A * 1/1984 Mochida ..... 70/422
5,379,617 A * 1/1995 Zagoroff ..... 70/18
5,447,049 A * 9/1995 Shieh ..... 70/360
5,655,391 A * 8/1997 Long ..... 70/56
5,669,255 A * 9/1997 Albano ..... 70/56
5,906,125 A * 5/1999 Shen ..... 70/370
6,564,602 B2 * 5/2003 Gregory ..... 70/360

* cited by examiner

*Primary Examiner*—Lloyd A. Gall
(74) *Attorney, Agent, or Firm*—Ramon L. Pizarro; Edwin H. Crabtree

(57) ABSTRACT

A shielded pushbutton lock that includes housing that supports a lock cylinder connected to a key operated pushbutton. The pushbutton is shielded by way of a rotatable collar that extends over the pushbutton and shields the pushbutton, so that a thief may not defeat the pushbutton lock mechanism by attempting to rotate the pushbutton in order to allow operation of the latch mechanism.

4 Claims, 2 Drawing Sheets

SHIELDED PUSHBUTTON LOCK

REFERENCE TO RELATED APPLICATIONS

This application is a continuation of my application having Ser. No. 09/838,630, filed Apr. 19, 2001, now U.S. Pat. No. 6,564,602, issued May 20, 2003, incorporated herein in its entirety by reference.

BACKGROUND OF THE INVENTION (a) Field of the Invention

This invention generally relates to a pushbutton lock that includes a shield or anti-theft feature about the pushbutton. More particularly, but not by way of limitation, to a pushbutton lock with a freely rotating collar around the pushbutton of the lock.

(b) Discussion of Known Art

Pushbutton locks, or the use of lock mechanisms that are opened or activated by way of a pushbutton are widely used. An important advantage to the use of these locks is that they can be easily installed in devices that are made from sheet metal or plastics. For example, the use of a pushbutton lock in storage boxes or lockers, such as the tool boxes or lockers used with pickup trucks or service trucks has nearly become an industry standard. Unfortunately, however, the pushbutton lock suffers from a serious security weakness in that many of these installations can be easily overcome with the use of a pair of pliers or a pipe wrench. To defeat the lock mechanism, the thief simple grips the protruding pushbutton with a pair of pliers or a wrench, and turns the pushbutton. The pushbutton is linked to a cam that contacts a latch actuator when the pushbutton lock is in an unlocked position. The contact of the cam with the latch actuator allows the lock mechanism to open by pressing the pushbutton. Pressing of the pushbutton causes the cam to move against the latch actuator, which in turn releases the lock mechanism, causing the lock mechanism to open. Thus, the cam is turned away from the latch actuator when the pushbutton lock is in the locked position, preventing contact of the cam with the latch actuator. Thus, a thief can defeat a pushbutton lock mechanism by simply turning the pushbutton to a position where the cam contacts the latch actuator mechanism. The pushbutton is easily turned with the aid of a pair of pliers, a pipe wrench, or the like.

Many artisans have approached the problem of tampering with locks by providing a shield or guard mechanism. However, pushbutton locks have remained vulnerable to thieves. Therefore, a review of known devices reveals that there remains a need for a system for preventing thieves from turning the pushbutton of a pushbutton lock. This protective mechanism should be simple, so that the mechanism does not complicate the simple installation process that is germane to the pushbutton lock mechanism. In other words, there remains a need for a system that protects pushbutton locks, and which does not involve creating a separate protective that is mounted on the lockbox or container that relies on the pushbutton lock.

Still further, there remains a need for a theft or tamper resistant pushbutton lock that can be installed using the same preparation and installation procedures as known pushbutton locks.

There remains a need for a pushbutton lock that prevents the turning of the pushbutton to prevent unauthorized access through the pushbutton lock.

SUMMARY

It has been discovered that the problems left unanswered by known art can be solved by providing a pushbutton lock that includes a rotatable shield around the pushbutton. Briefly stated, the invention includes a pushbutton that releases the latch mechanism, and a shield that is rotatably mounted around the pushbutton, so that the shield does not prevent the user from activating the pushbutton, but prevents the gripping of the sides of the pushbutton with a pair of pliers, wrench or similar tool.

According to one example of the invention the pushbutton lock includes a housing that is adapted for extending through a support panel, such as the lid of a box that is to be locked with the use of the pushbutton lock. The housing includes sides and a bottom. The bottom of the housing includes an aperture that allows the extension of a shaft that supports the cam that activates the latch mechanism of the lock. The shaft is connected to a cylinder that holds the lock's tumbler or key mechanism. The pushbutton is mounted against the cylinder, and is allowed to extend from the housing by way of a pushbutton opening in the housing, at a location opposite to the bottom of the housing.

In known pushbutton locks a spring is held within the housing, positioned between the bottom of the housing and the pushbutton. This spring urges the pushbutton outwardly from the housing. In one example of the disclosed invention, a collar is positioned around the pushbutton. In this example the collar includes sides and a bottom. The bottom of the collar includes an aperture that allows the cylinder mechanism or shaft to extend though the bottom. Thus, the spring will be positioned in the housing between the bottom of the housing and the collar. The pushbutton will be positioned within the collar.

Of course, it is contemplated that the collar may be simply cylindrical with an aperture of a generally constant size extending through the cylinder. With this configuration a retainer, such as a circular spring that nests in mating grooves in the pushbutton and the collar or a protruding element that extends from the pushbutton or the collar and into a grove in the mating part. Additionally, it is contemplated that other mechanisms, such as a bearing or other rigid component that resides in a common groove or similar engagement mechanism.

Thus, the collar will extend over the pushbutton, and prevent direct contact with the sides of the pushbutton. This will prevent thieves, or others trying to defeat the lock, from engaging and rotating the pushbutton to turn the shaft and accompanying cam in order to activate the latch mechanism and open the lock.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
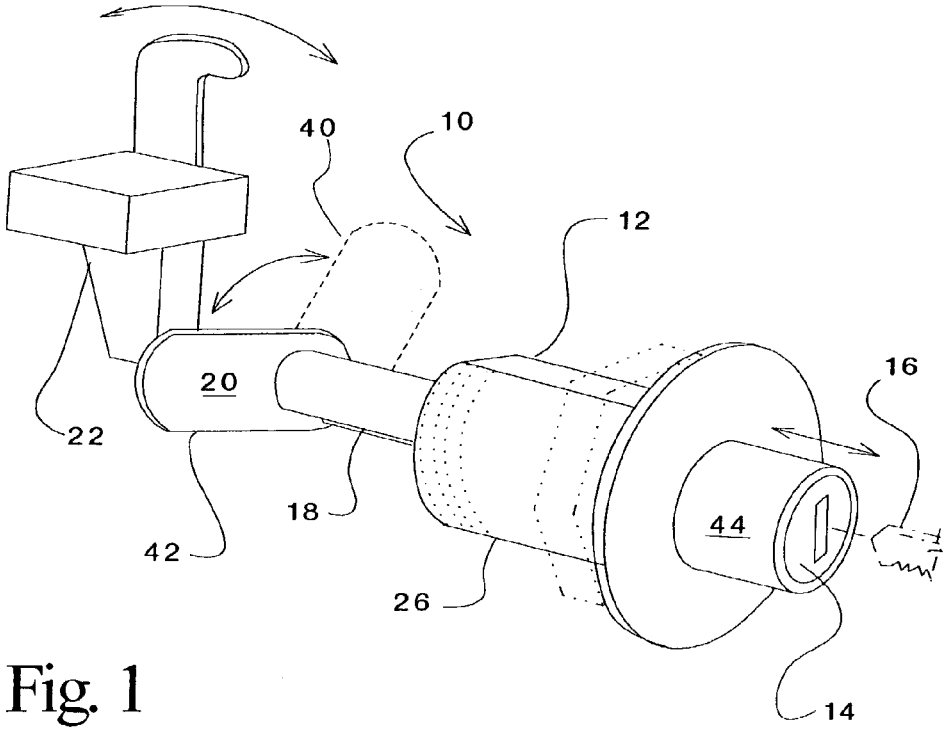
FIG. 1 is a perspective view of an embodiment of the invention. The view illustrating the cooperation of the cam and the latch mechanism, as well as the pushbutton and collar arrangement.

Turning now to FIG. 1 where a pushbutton lock 10 has been illustrated in conjunction with some of the components typically found in lock mechanisms that use a pushbutton key receptor and actuation mechanism. As found in FIG. 1, these mechanisms will use a keyed lock release mechanism 12. The keyed lock release mechanism 12 is held within the pushbutton 14. The keyed lock release mechanism 12 is activated or released by a key 16 that can turn a shaft 18. The shaft 18 is connected to a cam 20, which, as illustrated, may be a tab-shaped projection, or may be of any other shape that allows actuation of a latch mechanism 22 that allows opening of the door or panel that is being held close by the latch mechanism 22.

Figure 2:
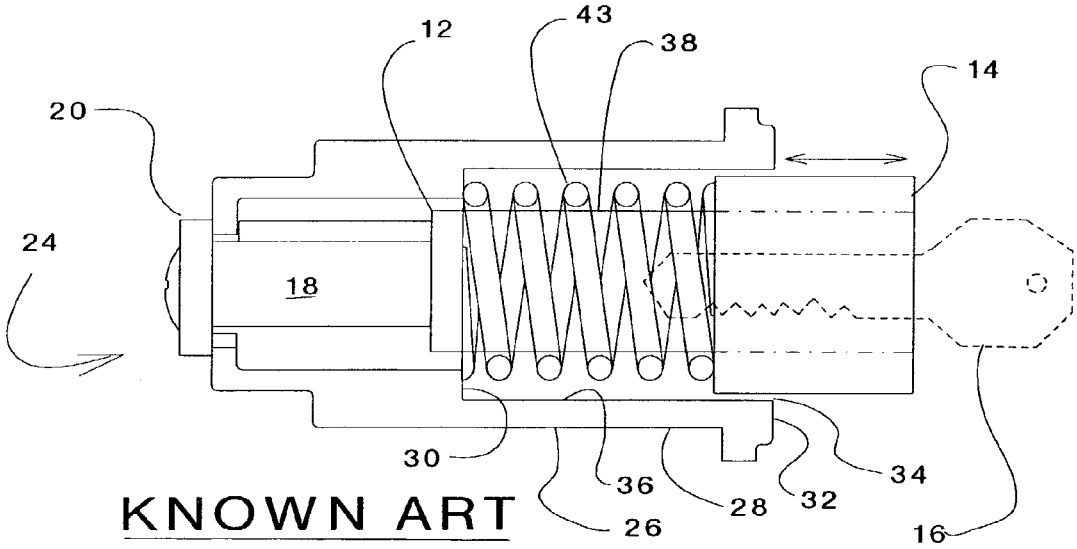
FIG. 2 is a side sectional view of the internal mechanism of a known pushbutton lock.

Turning now to FIG. 2, where a known pushbutton lock mechanism 24 has been illustrated. It is important to note that it is contemplated that the disclosed invention is particularly well suited for use with the illustrated pushbutton lock mechanism, it is also contemplated that the invention may be used on any other lock mechanism that uses a keyed locking mechanism that projects from a surface and which is connected to the latch actuation mechanism. The illustrated example of a known pushbutton lock mechanism 24 incorporates the pushbutton 14 that is held within a housing 26 that includes sides 28, a bottom end 30 and a front end 32. The housing also includes an aperture 34 that extends from the front end 32 towards the bottom end 30. The aperture 34 leads to an interior surface 36 that extends from the front end 32 towards the bottom end 30 of the housing 26.

The illustrations in FIGS. 1 and 2 show that inside the housing 26 is found a lock cylinder 38 that includes a mechanism that cooperates with the key 16 to allow the turning of the cam 20 from a locked position 40 to an unlocked position 42, which have been illustrated in FIG. 1. The lock cylinder 38 is held within the housing 26 and allows turning of the lock cylinder 38 through the pushbutton 14 when the corresponding key is inserted and turned. The turning of the key, which in-turn rotates the lock cylinder 38, positions the shaft 18 at a position that allows the pushbutton 14 to be pressed into the housing 26, and to release the latch mechanism 22 upon pressing of the pushbutton 14. A spring 43 urges the pushbutton 14 out from the front end 32 of the housing 26, so that the pushbutton 14 projects from the housing 26.

Figure 3:
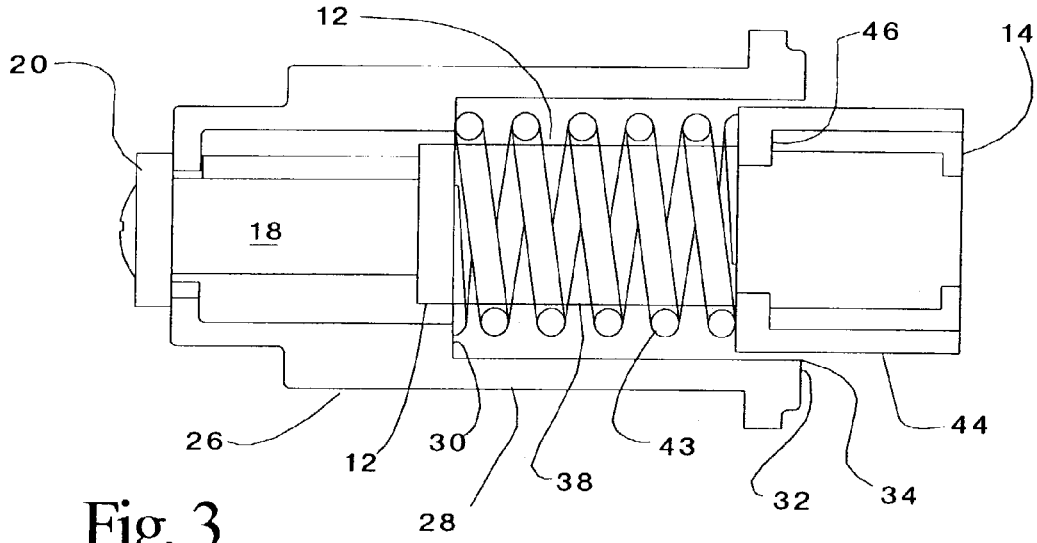
FIG. 3 is a side sectional view of an example of a pushbutton lock that incorporates the collar taught herein.

Turning now to FIG. 3 it will be understood that it is contemplated that a collar 44, such as the example illustrated in FIG. 3, will prevent the turning of the pushbutton 14 through the use of a torsional force, as applied with a pair of pliers or a wrench, for example. As shown on FIG. 3, it is contemplated that the collar 44 will extend over the pushbutton 14. In order to maintain the relationship of the collar 44 and the pushbutton 14, it is contemplated that the collar 44 will include a flange 46 that extends from the collar 44 and is positioned between the spring 43 and the pushbutton 14. Thus the spring 43 will urge the collar 44 and the pushbutton 14 together outwardly in the same manner as accomplished in known pushbutton locks. This preserves the actuation or operation of the pushbutton lock, so that the pushbutton lock will be actuated in a manner that is familiar to the ordinary user.

Figure 4:
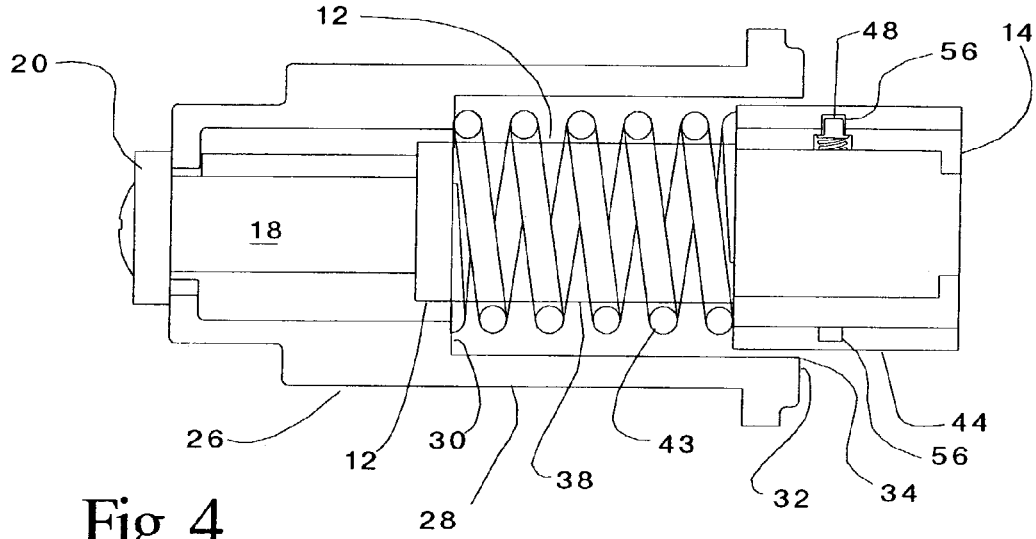
FIG. 4 is a side sectional view illustrating another example of a retaining mechanism for maintaining the relationship of the collar over the pushbutton.

As discussed above, one example of the disclosed invention uses the spring 43 to retain the collar 44, by way of the flange 46, in a desired position against the pushbutton 14. However, as illustrated in FIG. 4, it is contemplated that other mechanisms may be employed to maintain the position of the collar 44 relative to the pushbutton 14 to achieve the benefits of the disclosed invention. Thus, the example in FIG. 4 illustrates that a pin 48 or similar connector may be used to maintain the relationship between the collar 44 and the pushbutton 14. The example illustrated in FIG. 4 uses a spring to urge the pin 48 that cooperates with a groove 56 in the collar 44 is used to maintain the relationship of the collar 44 and the pushbutton 14. In this example the collar 44 is always free to rotate around the pushbutton 14. It is important to note that it is also contemplated that the pin 48 may be held in the collar 44 and the groove 56 may be found in the cylinder 34.

Figure 5:
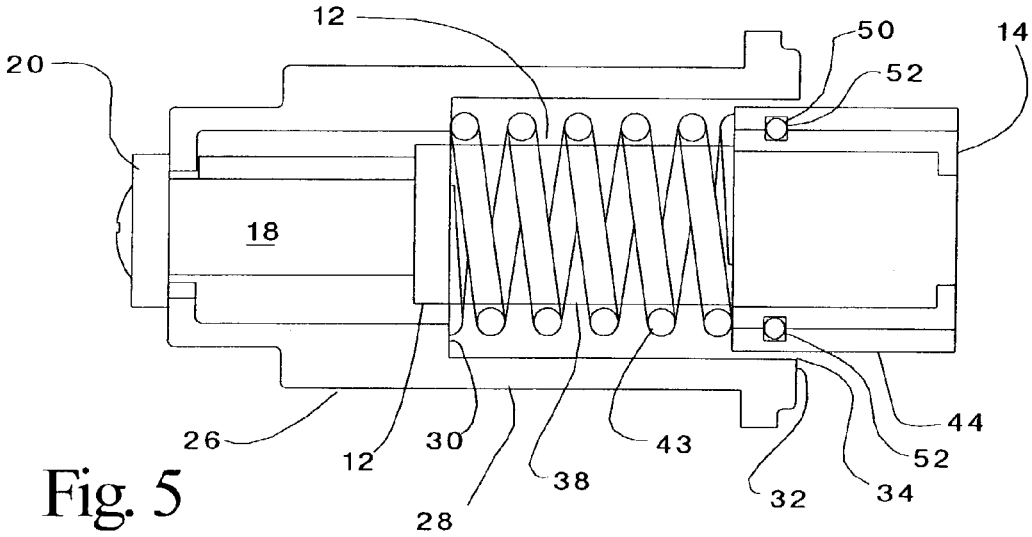
FIG. 5 is a side sectional view illustrating another example of a retaining mechanism for maintaining the relationship of the collar over the pushbutton.

FIG. 5 illustrates yet another example of a retaining mechanism for retaining the relationship of the collar 44 and the pushbutton 14 while in normal use. In this example a round retaining spring, wire, or rounded element 50 is positioned within a groove 52 that extends between the collar 44 and the pushbutton 14. Similarly, the components described above may be repositioned without departing from the spirit and scope of the disclosed invention.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A pushbutton lock that includes a housing, the housing having sides, a bottom end and a front end, the housing having an aperture extending from the front end towards the bottom end, the pushbutton lock comprising:

a lock cylinder, the lock cylinder being adapted for being supported within said housing, the lock cylinder being connected to a pushbutton, the pushbutton including an aperture for accepting a lock key that actuates the lock cylinder;

a spring that is adapted for urging said pushbutton towards the front end of the housing; and a cylindrical collar, the cylindrical collar extending over the pushbutton and being rotatably supported over the pushbutton, said collar further comprising a flange, said flange extending between said spring and said pushbutton, so that the pushbutton is shielded by the cylindrical collar.

2. The pushbutton lock described in claim 1, wherein said collar includes a groove and said collar is supported over said pushbutton by way of a protruding element that extends from the pushbutton and into the groove in said collar.

3. The pushbutton lock described in claim 1 and further comprising a pin that retains the relationship of said collar and said pushbutton.

4. The pushbutton lock described in claim 1, wherein said pushbutton includes a groove and collar includes a groove and said collar is supported over said pushbutton by way of an element that simultaneously extends into the groove in the pushbutton and into the groove in said collar.

* * * * *